US010934775B2

(12) United States Patent
Zhang

(10) Patent No.: US 10,934,775 B2
(45) Date of Patent: Mar. 2, 2021

(54) LOCKING DEVICE FOR A ROLLER BLIND

(71) Applicant: IKEA SUPPLY AG, Pratteln (CH)

(72) Inventor: Bo Zhang, Lund (SE)

(73) Assignee: IKEA Supply AG, Pratteln (CH)

( * ) Notice: Subject to any disclaimer, the term of this patent is extended or adjusted under 35 U.S.C. 154(b) by 249 days.

(21) Appl. No.: 16/313,569

(22) PCT Filed: Jun. 28, 2017

(86) PCT No.: PCT/SE2017/050713
§ 371 (c)(1),
(2) Date: Dec. 27, 2018

(87) PCT Pub. No.: WO2018/004436
PCT Pub. Date: Jan. 4, 2018

(65) Prior Publication Data

US 2019/0316414 A1 Oct. 17, 2019

(30) Foreign Application Priority Data

Jul. 1, 2016 (SE) ..... 1650958-0

(51) Int. Cl.
*E06B 9/80* (2006.01)
*E06B 9/322* (2006.01)
(Continued)

(52) U.S. Cl.
CPC ..... *E06B 9/80* (2013.01); *E06B 9/322* (2013.01); *E06B 9/42* (2013.01); *E06B 9/60* (2013.01); *E06B 2009/801* (2013.01)

(58) Field of Classification Search
CPC ... E06B 9/80; E06B 9/322; E06B 9/42; E06B 9/34; E06B 9/60; E06B 2009/801
See application file for complete search history.

(56) References Cited

U.S. PATENT DOCUMENTS 3,115,927 A * 12/1963 Znamirowski ..... E06B 9/60 160/301
4,009,745 A 3/1977 Erpenbeck
(Continued)

FOREIGN PATENT DOCUMENTS

DE 3002123 A1 7/1981
DE 19834777 A1 2/2000
(Continued)

OTHER PUBLICATIONS

Supplementary European Search Report for EP Application No. 17820653.8 dated Feb. 5, 2020 (5 pages).
(Continued)

*Primary Examiner* — Beth A Stephan
(74) *Attorney, Agent, or Firm* — Merchant & Gould P.C.

(57) ABSTRACT

The invention refers to a Locking device (200) for a pre-tensioning arrangement of a roller blind (2) or a venetian blind, comprising a sleeve (5) and a plug element (4) adapted to be inserted into the sleeve (5), a locking member (7) and a pin (6). The pin is adapted to be operated between a locking position and a releasing position. When set to the locking position the plug element (4) is prevented from being rotated in view of the sleeve (5). When set to the releasing position the plug element (4) is allowed to be rotated in view of the sleeve (5).

10 Claims, 5 Drawing Sheets

(51) Int. Cl.
*E06B 9/42* (2006.01)
*E06B 9/60* (2006.01)

(56) References Cited

U.S. PATENT DOCUMENTS

| | | | | |
|---|---|---|---|---|
| 4,373,569 | A | 2/1983 | Barettella | |
| 7,082,983 | B2 | 8/2006 | Coulibaly et al. | |
| 8,203,658 | B2 * | 6/2012 | Wang | H05K 5/0017 348/841 |
| 8,596,594 | B2 * | 12/2013 | Shevick | E06B 9/24 248/200.1 |
| 2014/0014281 | A1 | 1/2014 | Mullet et al. | |

FOREIGN PATENT DOCUMENTS

| | | | |
|---|---|---|---|
| GB | 339506 | A | 12/1930 |
| GB | 2000558 | A | 1/1979 |
| NL | 294920 | A | 4/1965 |
| WO | WO 2012/093089 | A1 | 7/2012 |
| WO | WO 2015/191427 | A2 | 12/2015 |

OTHER PUBLICATIONS

U.S. Pat. No. 179,319 issued Jun. 27, 1876—Johnston.
International Search Report and Written Opinion for PCT/SE2017/050713 dated Sep. 11, 2017.

* cited by examiner

LOCKING DEVICE FOR A ROLLER BLIND

This application is a National Stage Application of PCT/SE2017/050713, filed 28 Jun. 2017, which claims the benefit of priority to Swedish Patent Application No. 1650958-0, filed 1 Jul. 2016, which applications are incorporated herein by reference. To the extent appropriate, a claim of priority is made to each of the above disclosed applications.

TECHNICAL FIELD

The present invention concerns a locking device for a pre-tensioning arrangement of a roller blind or a venetian blind.

TECHNICAL BACKGROUND

Roller blinds are commonly powered by a spring which is tensioned as the roller blind is released. The thus accumulated tensioning is used later on to assist when the roller blind is to be raised. One example of a roller blind using a spring to provide a pre-tension is known from DE19834777A1. The spring is mounted around the tube with one end thereof fixed to the tube and the other end indirectly fixed to a bracket used to suspend the roller blind to a wall. As the blind is released the spring will be tensioned and as the blind is raised the thus tensioned spring will assist the raising.

It is advantageous to use a certain pre-tensioning already when suspending the roller blind to the window frame. This can in its easiest way be made manually when suspending the roller blind. The roller blind can also be delivered to the user with a certain pre-tensioning. In the latter case such pre-tensioning must be maintained until suspension.

One example to maintain a pre-tensioning is known from U.S. Pat. No. 7,082,983 B2 in which pivotable ratchet is used.

Another example to maintain pre-tensioning is to provide the roller blind with a head rail, also known as a top track which is fixedly attached to both sides of the roller blind. The opposite ends of the head rail may be attached to or be provided with brackets that are used to suspend the roller blind to a window frame. The head rail grasps the opposite ends of the tube onto which the blind is to be wound. Such head rail does however make the roller blind more bulky and it is not possible for the user to cut the roller blind to a width that fits a specific window.

SUMMARY

One object of the present invention is to provide a locking mechanism that maintains a pre-tensioning of a spring of a roller blind which spring is used to assist raising of a roller blind. The locking mechanism should be easy to release when the roller blind is to be suspended to a window frame and it should also be as easy to set to a locked position in case the roller blind should be unsuspended. Further, the locking mechanism should be easy to use without the need for any tooling.

These and other objects are solved by a locking device for a pre-tensioning arrangement of a roller blind or a venetian blind, comprising a sleeve and a plug element adapted to be inserted into the sleeve, a locking member and a pin, wherein the sleeve on its inner circumferential surface comprises at least one recess; the plug element comprises a wall having a longitudinal and circumferential extension, and the wall defining a cavity adapted to receive the pin, and wherein the wall comprises a through-going opening, the opening being adapted to receive the locking member; the pin along its longitudinal extension comprises a locking portion and a releasing portion, and wherein the pin is movable inside and along the longitudinal extension of the cavity of the plug element between a locking position and a releasing position; in which locking position the locking portion of the pin longitudinally coincides with the through-going opening of the wall, whereby the locking member will engage the locking portion and be urged by the locking portion radially outwardly into the recess of the sleeve thereby preventing the plug element from being rotated in view of the sleeve, and in which releasing position the releasing portion of the pin longitudinally coincides with the through-going opening of the wall, whereby the locking member will engage the releasing portion of the pin and be allowed to move radially inwardly out of the recess of the sleeve, thereby allowing the plug element to be rotated in view of the sleeve.

The plug element may be seen as a stator whereas the sleeve and the tube may be seen as a rotor. Depending on the position of the pin in the cavity, the locking member will either allow the sleeve and tube to freely rotate in view of the plug element or engage the plug element and the sleeve in a locking manner. The latter is a default position as long as the roller blind is not suspended to a window frame. The locking device is adapted to be inserted into the open end of the tube onto which a blind is to be wound. Thereby all components of the locking device are fully protected from the ambience preventing any foreign items to interfere the operation. Further the locking device may be operated by an actuator engaging and thereby setting the pin to its re-leasing position. Such actuator may be integrated in a bracket which is used to suspend the roller blind to a window frame. When the roller blind is de-suspended the pin and hence the locking device is automatically set to its locking position.

The cavity as seen in the longitudinal direction of the wall may comprise a first abutment and a second abutment, and wherein the pin is biased towards the second abutment by a spring acting between the first abutment and the pin, and wherein the second abutment comprises at least one opening allowing the pin to be operated by an actuator to thereby be moved from the locking position to the releasing position. The actuator may be arranged in a bracket used to suspend the roller blind in a window frame. By the biased pin, the roller blind will automatically be set to a locking position when the roller blind is de-suspended. Thereby a pre-tensioning of the roller blind will be maintained.

The locking device may further comprise a pre-tensioning spring having a first and a second end, the first end being connected to the plug element and the second end being connected to the sleeve.

The plug element may extend through and past the sleeve, and the plug element may as seen in a position past the sleeve comprise a connector. A first end of a pre-tensioning spring may be connected to the connector and a second end of the pre-tensioning spring may be connected to the sleeve. Thereby, when the pin of the locking device is set to the releasing position, the spring will be turned and tensioned as the tube and the sleeve is allowed to rotate in view of the plug element, i.e. when the blind is released.

The plug element may as seen along its longitudinal extension be connected to a shaft, wherein the plug element and the shaft are interconnected by a driver. By connecting the plug element to a shaft the plug element may be given a longitudinal extension that allows it to extend past the sleeve and allow a pre-tensioning spring to extend between the sleeve and the plug element. Such spring may depending on the length of the shaft be allowed to have a longer operating length.

The locking member may be a ball or a peg. The locking element is arranged to be received in a pocket defined between the inner circumferential surface of the sleeve, the through-going-opening in the wall of the projection portion of the plug element and the pin. More precisely, the part of the pin facing the pocket can be either the locking portion or the releasing portion depending on if the actuator operates the pin or not.

A plurality of recesses may be arranged side by side in the circumferential direction on the inner circumferential surface of the sleeve. Although it would be sufficient with only one recess, a plurality of recesses will improve the locking effect since the angular displacement of the tube before providing a locking engagement between the locking member and a recess will be reduced.

The sleeve may along its outer circumferential surface comprise at least one longitudinal projection adapted to engage at least one recess on the inner wall of a tube supporting the blind of a roller blind or a venetian blind. Thereby a driving engagement may be formed which ensures that the sleeve will always rotate together with the tube as one unitary body.

The side walls of the at least one recess may as seen in the radial direction of the sleeve be arc shaped or V-shaped forming an obtuse angle. Thereby, the locking member will easily move into and out of engagement with the recess no matter direction of the rotation of the tube.

According to another aspect, the invention refers to a roller blind or a venetian blind comprising a tube supporting a blind, wherein the tube comprises a locking device according to any of the features given above.

Further objects and advantages of the present invention will be obvious to a person skilled in the art reading the detailed description given below describing different embodiments.

BRIEF DESCRIPTION OF THE DRAWINGS

The invention will be described in detail with reference to the schematic drawings.

DETAILED DESCRIPTION

Figure 1:
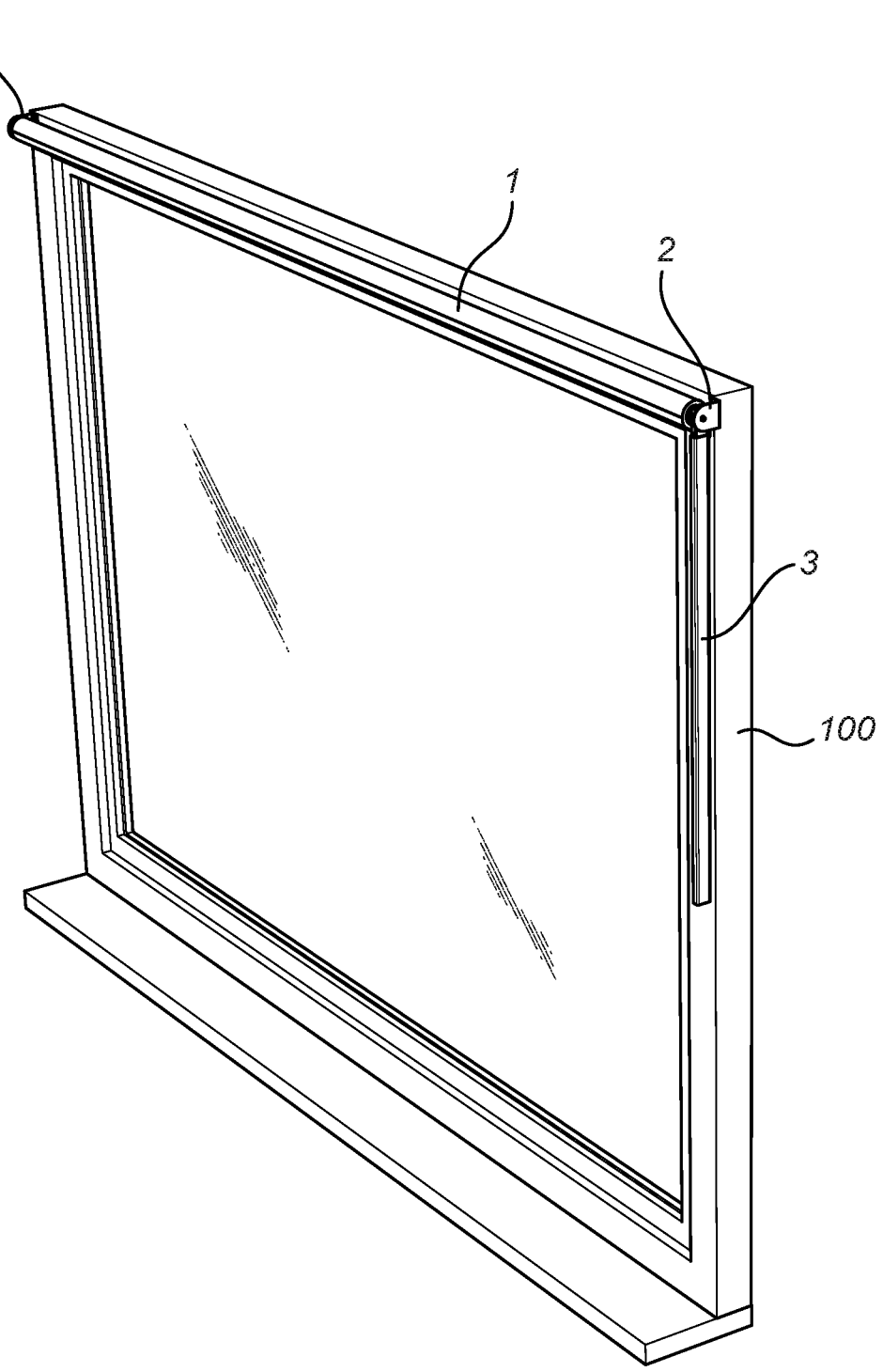
FIG. 1 discloses a window with a roller blind.

Now turning to FIG. 1 a window with a roller blind 1 is schematically disclosed. The roller blind 1 is mounted at its two opposing free edges along the upper border of the window frame 100 by means of brackets 2. The roller blind 1 is operated by a pull cord actuator 3. By pulling the pull cord actuator 3 the blind is either released or raised. This mechanism is well known in the art and is not further discussed. The invention will throughout the description and the illustrations refer to a roller blind. The very same principle is equally applicable to a venetian blind. The essential difference is that instead of winding a blind onto the tube, the cords of the venetian blind are wound onto the tube.

Figure 2:
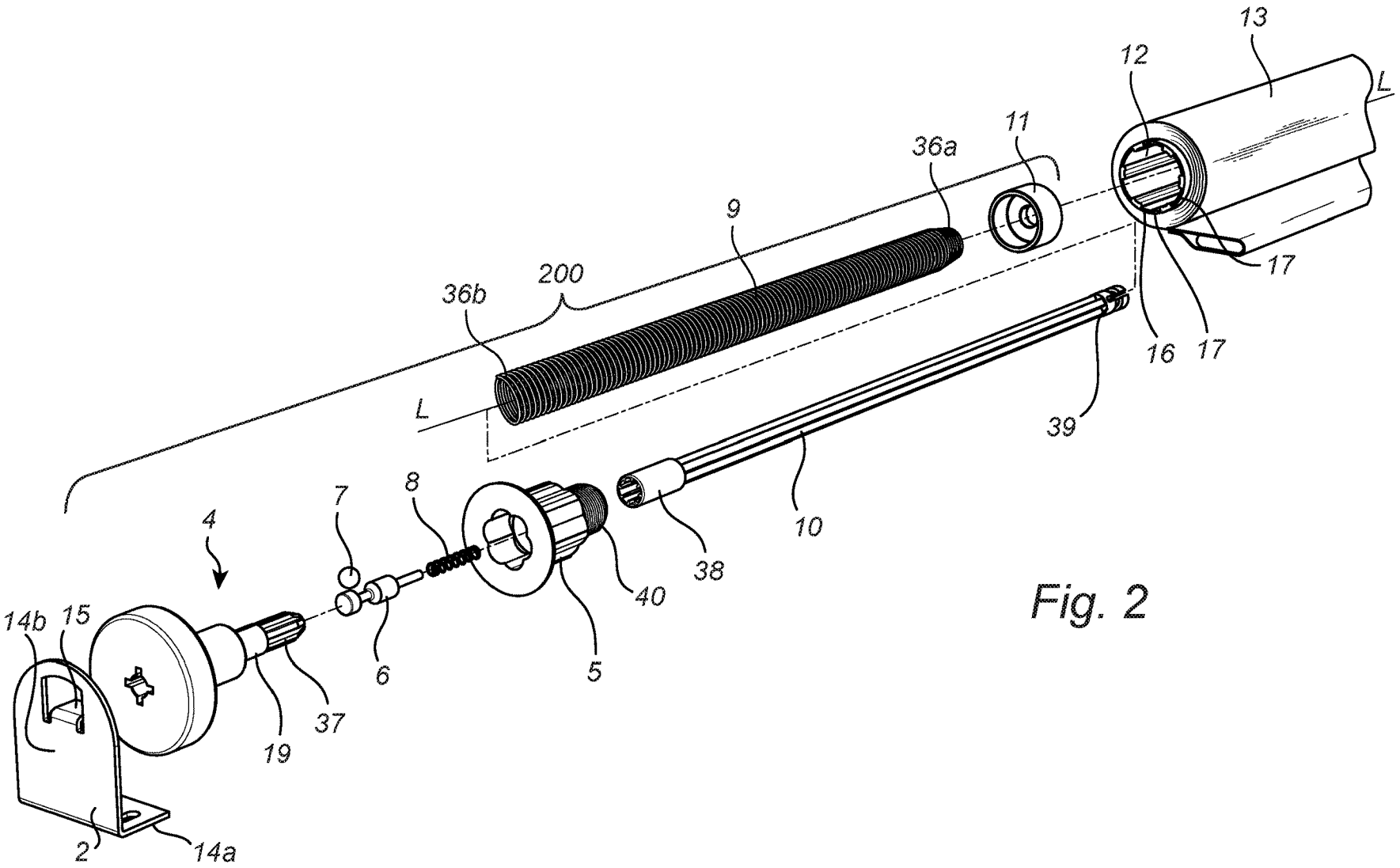
FIG. 2 discloses an exploded view of the locking device with its components.

Now turning to FIG. 2 an exploded view of a pre-tensioning arrangement of a roller blind or a venetian blind is disclosed. All parts will be discussed in detail below. Starting from the left, the arrangement discloses a bracket 2, a locking device 200 comprising a plug element 4, a sleeve 5, a pin 6, a locking member 7, a biasing spring 8, a pre-tensioning spring 9, a shaft 10 forming part of the plug element 4 and a connector plug 11. The locking device 200 is arranged to be mounted by insertion into a tube 12 supporting a blind 13.

The bracket 2 is used to support the roller blind 1 when mounting the same to a window frame. Brackets 2 are arranged at the opposing ends of the roller blind 1. The bracket 2 is in its simplest form formed by an L-shaped member having a first flange 14*a* and a second flange 14*b*. The first flange 14*a* is adapted to be mounted to the window frame by e.g. screws (not disclosed). The second flange 14*b* is provided with a projecting actuator 15 adapted to operate the locking device 200.

The tube 12 is well known in the art. In the disclosed embodiment it is formed by an extruded tube having a circular cross section. The inner wall 16 of the tube 12 is provided with at least one recess 17 forming part of a driver. In the disclosed embodiment a plurality of recesses 17 are provided, each recess having an extension in parallel with the longitudinal center axis L of the tube and hence the rotational axis of the roller blind 1. The tube 12 may be provided by extrusion and cut to desired length depending on the width of the window frame 100.

The blind 13 is wound onto the outer surface of the tube 13. The blind 13 may be any type of material suitable for winding, such as textile, plastic, metal film or paper.

Now turning to FIGS. 4*a* and 4*b* the design of the plug element 4 will be described.

Figure 3A:
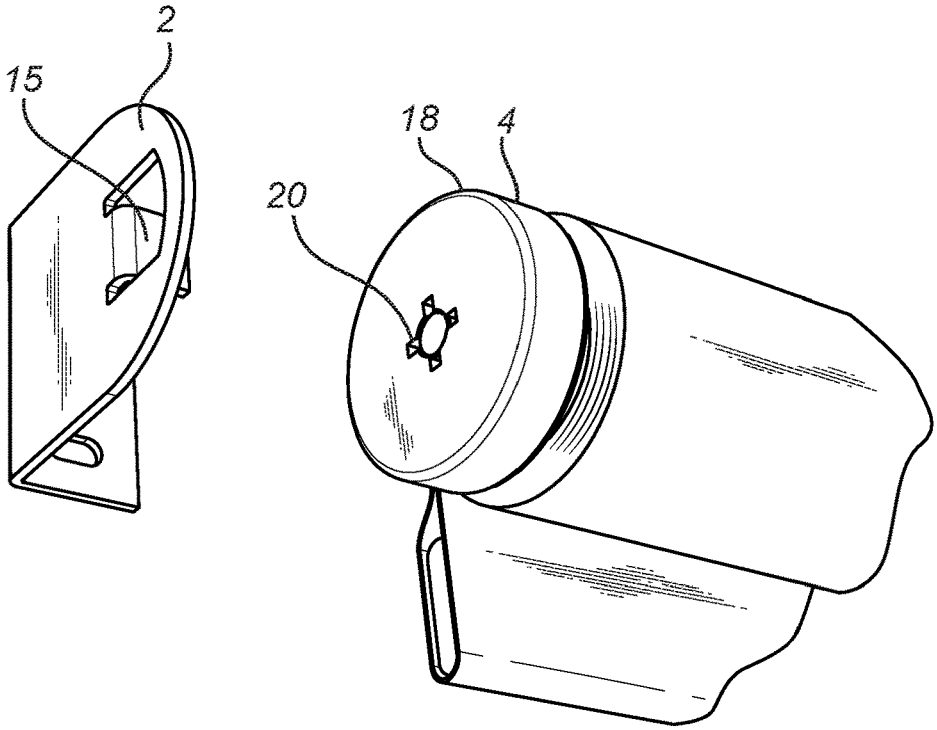
FIGS. 3*a* and 3*b* disclose a roller blind provided with the inventive locking device before and after being mounted to a bracket.
Figure 3B:
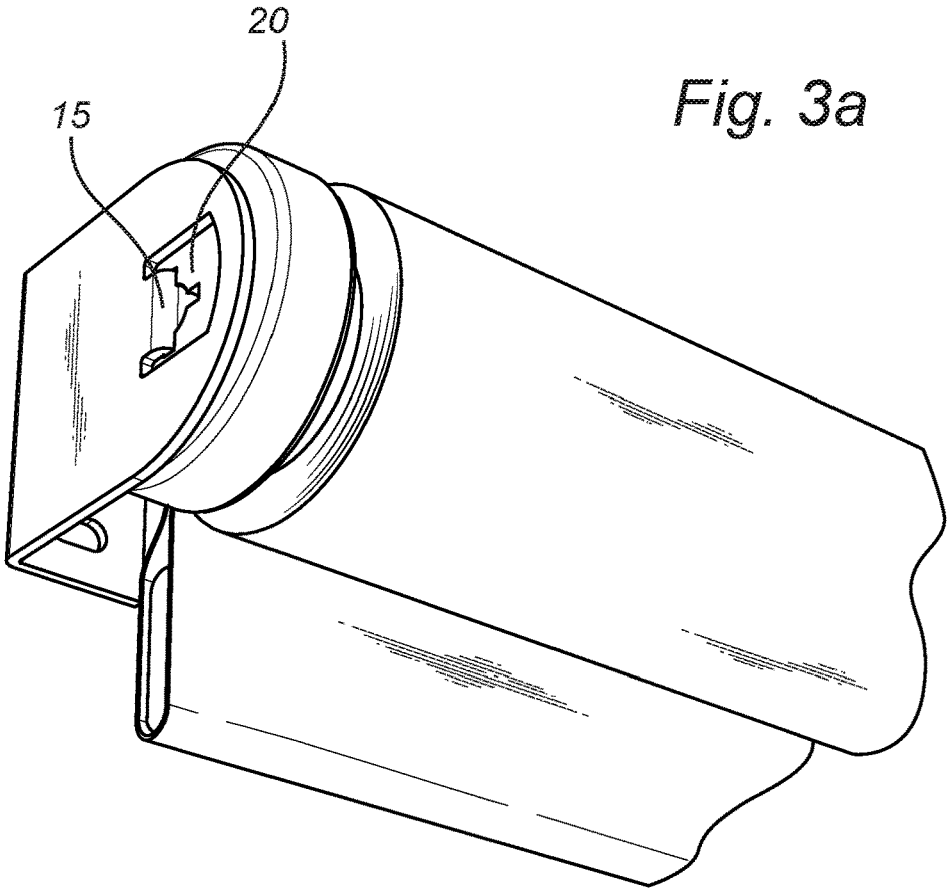

The plug element 4 comprises a flange portion 18 having a radial extension and a projection portion 19 having a longitudinal extension. The flange portion 18 has in its radial surface an opening 20 adapted to allow insertion of the actuator 15 of the bracket 2. In the disclosed embodiment, also seen in e.g. FIGS. 3*a* and 3*b*, the opening 20 is formed as a cross. Other geometries are possible.

The flange portion 18 preferably has a diameter exceeding the diameter of the sleeve 5 and the tube 12 to form an end closure of the tube 12 when mounted thereto.

The projection portion 19 has a longitudinal wall 21 adapted to be inserted into the sleeve 5 and extend coaxially therewith. The wall 21 defines a longitudinal cavity 22. The cavity 22 is in the longitudinal direction delimited by a first abutment 23 and a second abutment 24. The second abutment 24 is provided by the flange portion 18 and hence the opening 20 in the flange portion 18 sets the cavity 22 in communication with the ambience via said opening 20.

The pin 6 is received in the cavity 22 and extends coaxially with the longitudinal extension of the plug element 4. The pin 6 is biased towards the second abutment by a spring 25 acting between the first abutment 23 and the pin 6. When the actuator 15 is inserted into the opening 20, the pin 6 is moved towards the first abutment 23 and is thereby moved from a locking position (see FIG. 4*a*) to a releasing position (see FIG. 4*b*).

The pin 6 comprises along its longitudinal extension a locking portion 26 and a releasing portion 27. The locking portion 26 is formed by a portion having a diameter D and the releasing portion 27 is formed by a portion having a diameter d, where the diameter D of the locking portion 26 exceeds the diameter d of the releasing portion 27.

In the disclosed embodiment the locking portion merges into the releasing portion by a chamfering 28 to be discussed below.

The wall 21 of the projection portion 19 comprises a through-going opening 29 extending in the radial direction. The through-going opening 29 is adapted to receive the locking member 7 to be discussed below.

The plug element 4 is inserted into the sleeve 5. When the plug element 4 is fully inserted into the sleeve 5, the plug element 4 abuts a shoulder 34 arranged inside the sleeve 5.

The sleeve 5 has a flange portion 30 and a projection portion 31. The flange portion 30 has a diameter that exceeds the diameter of the tube 12. When the sleeve 5 is inserted into the tube 12 the flange portion 30 acts as a stopper preventing the sleeve 5 from being fully inserted into the tube 5. The outer circumferential surface of the sleeve 5 is provided with at least one longitudinal projection 32 adapted to engage the corresponding at least one recess 17 of the tube 12, thereby forming a driving engagement. Thus, when the sleeve 5 is inserted into the tube 12 the sleeve 5 will rotate together with the tube 12.

The sleeve 5 comprises on its inner circumferential surface at least one recess 33. In the disclosed embodiment a plurality of recesses 33 are arranged side by side in the circumferential direction. The recesses 33 do each have an arc shaped cross section as seen in the radial direction of the sleeve. Thereby, the locking member 7 will easily move into and out of engagement with the recess 33 no matter direction of the rotation of the tube 12. Other cross sections are possible, such as a V-shape. In case of a V-shape it is preferred that the V has an obtuse angle.

The at least one recess 33 is positioned to radially overlap the locking portion 26 of the pin 6 in a position when the locking device is in-activated.

A pocket 35 is defined between the inner circumferential surface of the sleeve 5, the through-going-opening 29 in the wall 21 of the projection portion 19 of the plug element 4 and the pin 6. More precisely, the part of the pin 6 facing the pocket 35 can either be the locking portion 26 or the releasing portion 27 depending on if the actuator 15 acts on the pin 6 or not. The pocket 35 contains the locking member 7. In the disclosed embodiment the locking member 7 is a ball. It goes without saying that the same principle is applicable also with the locking member 7 having other geometries such as a peg.

As is best seen in FIG. 2, the locking device 200 further comprises the pre-tensioning spring 9 allowing a pre-tensioning of the tube 12. The pre-tensioning spring 9 has a first and a second end, the first end 36*a* being connected to the plug element 4 and the second end 36*b* being connected to the sleeve 5.

In the disclosed embodiment the projection portion 19 of the plug element 4 comprises in its end facing away from the flange portion 18 a driver 37. The driver 37 engages a first end 38 of the shaft 10 which extends aligned with the longitudinal extension of the projection portion 19. By the driver 37, the shaft 10 will rotate together with the plug element 4. The opposite end of the shaft 10 comprises a connector 39 adapted to engage the first end 36*a* of the spring 9. The connector 39 interacts with the connector plug 11. The second end 36*b* of the pre-tensioning spring 9 is adapted to engage the sleeve 5 which in its outer surface is provided with a connector 40. In the disclosed embodiment the connector 40 on the sleeve 5 is formed as threads onto which the second end 36*b* of the pre-tensioning spring 9 is threaded.

The degree pre-tensioning of the spring 9 can be set in two ways. Firstly, as a pure design matter the spring 9 may be selected to have a determined spring constant. Secondly, by threading the spring 9 to the connector 39 of the sleeve, the active length of the spring 9 may be adjusted. In the following the operation of the locking device 200 will be discussed with reference to FIGS. 4*a* and 4*b*.

Figure 4A:
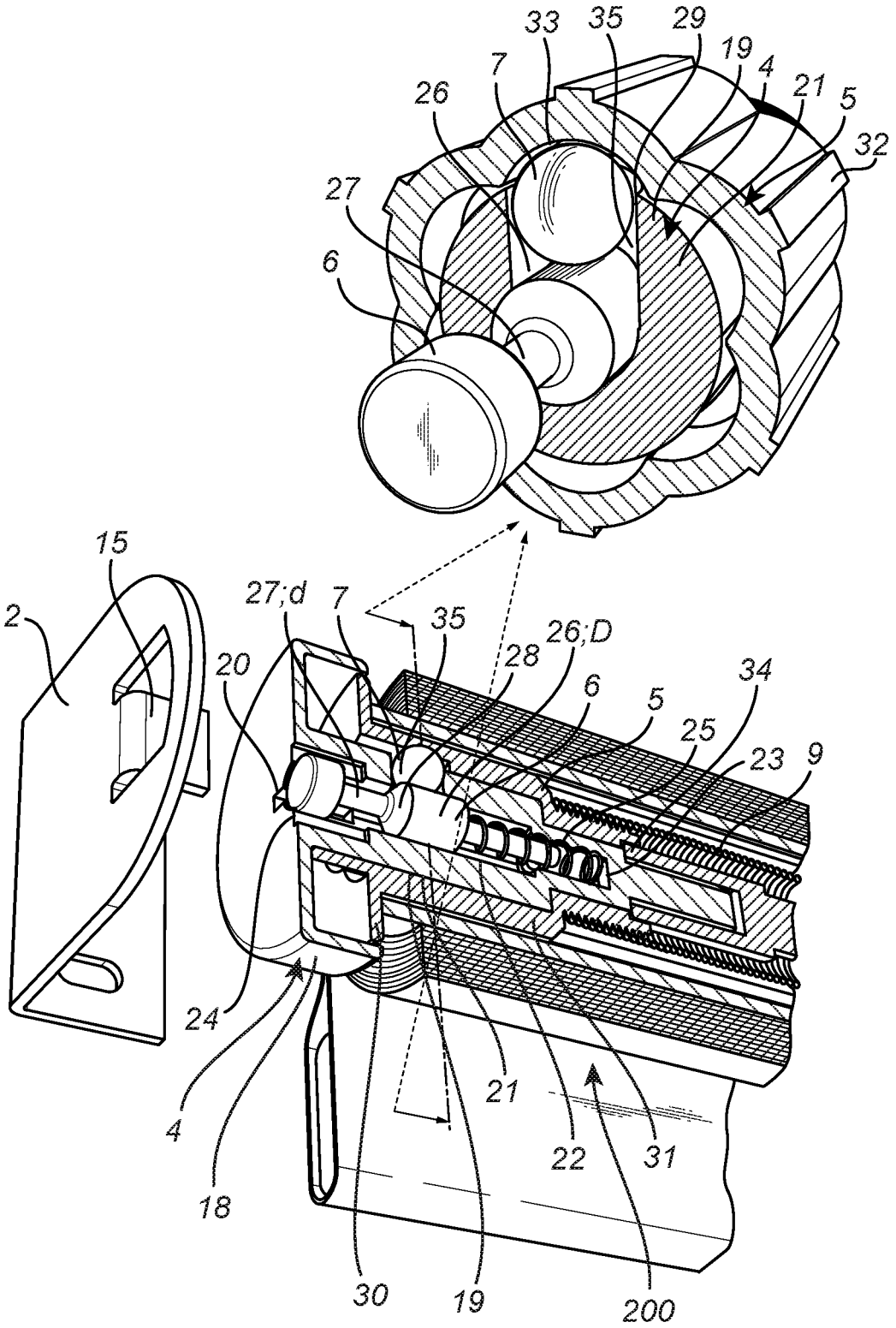
FIGS. 4*a* and 4*b* disclose a longitudinal cross section of the locking device to illustrate the operation.

Starting with FIG. 4*a* the locking device 200 is shown when set to its locking position. This is can be seen as an in-activated condition which the inventive locking device automatically takes when not suspended. In this condition the tube 12 is prevented from rotation in view of the plug element 4.

In the locking position the pin 6 is biased by the spring 8 towards the second abutment 24. Thereby the locking portion 26 of the pin 6 defines a part of the pocket 35. The locking member 7 is pressed by the locking portion 26 of the pin 6 to engage the recess 33 of the sleeve 5. Thereby the plug element 4 will rotate together with the sleeve 5 and the tube 12. Also, in this condition the pre-tensioning spring 9 will remain its pre-tensioning.

Figure 4B:
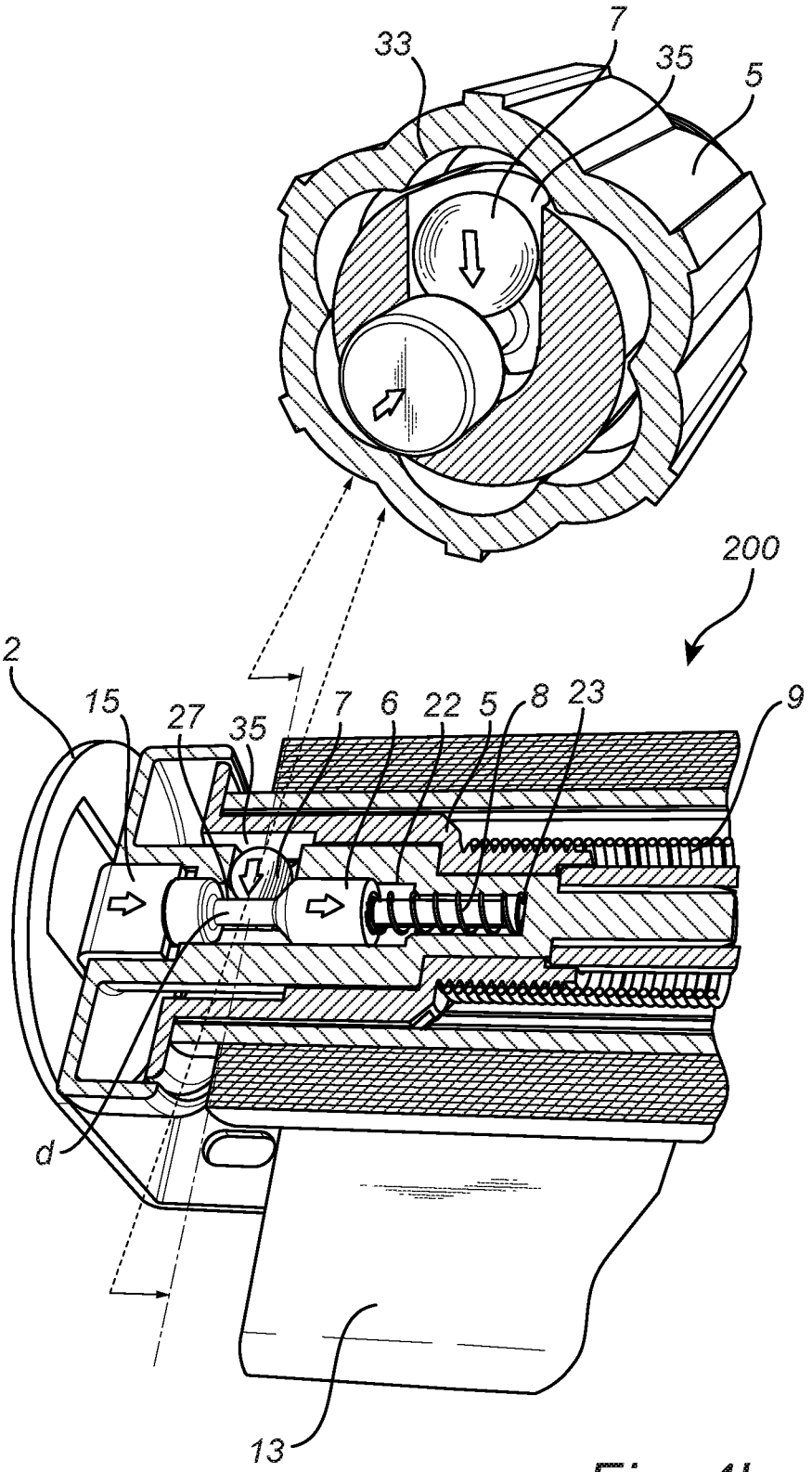

In FIG. 4*b* the locking device 200 is set to a releasing position by suspending the roller blind in a bracket 2. The actuator 15 engages the pin 6 and forces it to be moved inside the cavity 22 towards the first abutment 23. In this position the releasing portion 27 of the pin 6 defines a part of the pocket 35. Due to the smaller diameter d of the releasing portion 27, the locking member 7 is allowed to release its locking engagement with the recess 33 of the sleeve 5. Thereby the sleeve 5 and the tube 12 will be allowed to rotate together in view of the plug element 4. Hence, the blind 13 may be freely released or raised. When rotating the sleeve 5 together with the tube 12 in view of the plug element 4 the pre-tensioning spring 9 will be either additionally tensioned or partially released depending on if the blind is released or raised.

If the roller blind should be de-suspended, the pin 6 will automatically, due to the biasing-spring 8, return to its locking position. During this return stroke of the pin 6, the locking member 7 will be lifted by the chamfering 28 to lockingly engage the nearest recess 33 of the sleeve 5. The chamfering 28 also serves the purpose that it prevents the pin 6 from falling out of the cavity 22 by engaging the plug element 4.

It is appreciated that the embodiments of the invention as disclosed above may be altered in different ways within the scope of the appended claims.

By way of example, it is to be understood that the locking device 200 can be arranged on either end of the roller blind 1.

The pin 6 has been disclosed with a circular cross section. It is to be understood that other cross sections with remained function are applicable. The tube 12 may have other cross sections than circular with remained function.

The bracket 2 has been described and illustrated as an L-shaped member having a first flange 14*a* and a second flange 14*b* where the second flange 14*b* is provided with a projecting actuator 15 adapted to engage and operate the locking device 200. It is to be understood that the bracket may be formed as a unitary injection molded body with an axial projection adapted to engage the cross shaped opening 20 in the plug element 4 of the locking device 200. By providing such projection with a mating cross-shaped cross section, a firm engagement between the locking device and the bracket may be provided. Also, an intuitive mounting may be ensured. It is to be understood that also other cross sections of the projection and opening 20 may be used.

The invention claimed is:

1. Locking device for a pre-tensioning arrangement of a roller blind or a Venetian blind, comprising a sleeve and a plug element adapted to be inserted into the sleeve, a locking member and a pin, wherein the sleeve on its inner circumferential surface comprises at least one recess;

the plug element comprises a wall having a longitudinal extension and a circumferential extension, and the wall defining a cavity adapted to receive the pin, and wherein the wall comprises a through-going opening, the through-going opening being adapted to receive the locking member;

the pin comprises a longitudinal extension, and a locking portion and a releasing portion along the pin longitudinal extension, and wherein the pin is movable inside the cavity and along the longitudinal extension of the plug element between a locking position and a releasing position;

in which locking position the locking portion of the pin longitudinally coincides with the through-going opening of the wall, whereby the locking member will engage the locking portion and be urged by the locking portion radially outwardly into the recess of the sleeve thereby preventing the plug element from being rotated in view of the sleeve, and in which releasing position the releasing portion of the pin longitudinally coincides with the through-going opening of the wall, whereby the locking member will engage the releasing portion of the pin and be allowed to move radially inwardly out of the recess of the sleeve, thereby allowing the plug element to be rotated in view of the sleeve.

2. Locking device according to claim 1, wherein the cavity as seen in the longitudinal direction of the wall comprises a first abutment and a second abutment, and wherein the pin is biased towards the second abutment by a spring acting between the first abutment and the pin, and wherein the second abutment comprises at least one opening allowing the pin to be operated by an actuator to thereby be moved from the locking position to the releasing position.

3. Locking device according to claim 1, wherein the locking device further comprises a pre-tensioning spring having a first and a second end, the first end being connected to the plug element and the second end being connected to the sleeve.

4. Locking device according to claim 1, wherein the plug element extends through and past the sleeve, and wherein the plug element as seen in a position past the sleeve comprises a connector, and wherein the locking device further comprises a pre-tensioning spring having a first and a second end, the first end being connected to the connector and the second end being connected to the sleeve.

5. Locking device according to claim 3, wherein the plug element as seen along its longitudinal extension is connected to a shaft, wherein the plug element and the shaft are interconnected by a driver.

6. Locking device according to claim 1, wherein the locking member is a ball or a peg.

7. Locking device according to claim 1, wherein a plurality of recesses are arranged side by side in the circumferential direction on the inner circumferential surface of the sleeve.

8. Locking device according to claim 1, wherein the sleeve along its outer circumferential surface comprises at least one longitudinal projection adapted to engage at least one recess on the inner wall of a tube supporting the blind of a roller blind or a Venetian blind.

9. Locking device according to claim 1, wherein the at least one recess of the sleeve has an arc shaped or V-shaped cross section as seen in the radial direction of the sleeve.

10. A roller blind or a Venetian blind comprising a tube supporting a blind, wherein the tube comprises a locking device according to claim 1.

* * * * *